US005621704A

United States Patent [19]

Baba et al.

[11] Patent Number: 5,621,704

[45] Date of Patent: Apr. 15, 1997

[54] TIMEPIECE MOVEMENT WITH A SECOND STOP DEVICE

[75] Inventors: Koji Baba; Katsuhiro Hatano, both of Tokyo, Japan

[73] Assignee: Seiko Clock Inc., Japan

[21] Appl. No.: 548,021

[22] Filed: Oct. 25, 1995

[30] Foreign Application Priority Data

Oct. 25, 1994 [JP] Japan ..... 6-260769
Sep. 27, 1995 [JP] Japan ..... 7-249296

[51] Int. Cl.[6] ..... G04B 11/00

[52] U.S. Cl. ..... 368/110; 368/157; 368/160; 368/80

[58] Field of Search ..... 368/157, 160, 368/80, 110

[56] References Cited

U.S. PATENT DOCUMENTS 4,122,663 10/1978 Kock ..... 368/112
4,623,361 11/1986 Muto ..... 368/80
4,716,783 1/1988 Hayashi ..... 74/527
4,885,730 12/1989 Miyazawa ..... 368/157
4,932,011 6/1990 Schwartz ..... 368/185
5,197,045 3/1993 Miyazawa ..... 368/157

FOREIGN PATENT DOCUMENTS 1441210 6/1976 United Kingdom .
1527837 10/1978 United Kingdom .
2197969 6/1988 United Kingdom .

*Primary Examiner*—Bernard Roskoski
*Attorney, Agent, or Firm*—Adams & Wilks

[57] ABSTRACT

A timepiece movement comprises a rotor driven for intermittent rotation by a stepping motor, a speed-reducing wheel train and a second stop device. The speed-reducing wheel train has a movement conversion mechanism for transmitting intermittent rotary movement of the rotor to continuous rotary movement of a second hand wheel in a smooth manner. The second stop device is moveable between a first position, for immediately stopping the second hand wheel, and a second position, for immediately moving the second hand wheel at a predetermined speed.

23 Claims, 5 Drawing Sheets

TIMEPIECE MOVEMENT WITH A SECOND STOP DEVICE

BACKGROUND OF THE INVENTION

1. Field of the Invention

The present invention relates generally to a timepiece movement, and more particularly to a timepiece movement having a second stop device wherein a stepping motor serves as a drive source to continuously rotate a second hand wheel substantially in a smooth manner.

2. Background Information

The mechanism of a quartz timepiece movement is such that the rotation of a driving motor is transmitted to a second hand wheel through a gear train to rotate the second hand wheel, and the rotation of the second hand wheel is usually reduced for rotating a minute hand wheel whose rotation is in turn reduced for rotating an hour hand wheel. A stepping motor having a very low battery power consumption is employed as the driving motor. The stepping motor undergoes an intermittent rotary movement, and the second hand wheel is, therefore, designed to undergo intermittent motion at intervals of a second. However, consumers have long desired a timepiece movement in which the second hand wheel undergoes a sweeping motion to enable an indicating hand connected to the second hand wheel to indicate the progress of time continuously.

A sweeping motor has been employed in timepiece movements for realizing a sweeping motion of the second hand wheel. However, sweeping motors have the drawbacks of being expensive to manufacture and having a high battery power consumption.

Proposals have been made for use of motion converting means for imparting a continuous rotary movement to the second hand wheel in the mechanism of a timepiece movement employing a stepping motor as a source of driving force (see, e.g., Japanese Utility Model Application KOKAI No. Hei 2-128994). The proposals include transmitting the rotation of a stepping motor through a gear fixed to a bush fitted loosely about a second hand shaft, and imparting continuous rotation to the second hand shaft by a motion converting means provided in a rotation transmission path and located downstream of the bush.

The proposed motion converting means includes, as a first means, a disk positioned above the bush fitted loosely about the second hand shaft and surrounding the bush rotatably with the second hand shaft, while a spirally wound spring is connected between the bush and the disk to absorb a variation in velocity due to intermittent rotary movement.

As a second means, the motion converting means includes a plate-like member fitted loosely about the leading end of the second hand shaft and connected to the disk by a spring so as to be driven by the disk and thereby absorb a difference in velocity due to intermittent rotary movement.

As a third means, the motion converting means includes a viscous fluid, such as a lubricant, filling a tightly sealed container in which the plate-like member is held, so that the viscosity resistance which results from the rotation of the plate-like member in the viscous fluid imparts a smooth continuous rotary movement to the second hand shaft.

The following two stop means are generally known as second stop devices for use in a quartz timepiece movement.

A first stop means mechanically stops rotation of a wheel in a timepiece wheel train. As shown, for example, in FIG. 5, rotation of a rotor 41 is stopped by mechanical means. A stator 43 is mounted to a lower plate 42. The rotor 41 is rotatably mounted to the magnet section of the stator 43. A drive wheel 44 is meshed with the rotor 41. A rotor stop member 45 is reciprocally moved on an upper plate (not shown). The rotor stop member 45 includes a locking arm **45*a* for engagement with and disengagement from a rotor pinion 41*a* which is mounted to the rotor 41, a click arm 45*b* resiliently in contact with a click post 42*a* which extends from the lower plate 42, a tongue 45*c* guided by a guide post 42*b* which extends from the lower plate 42, and a reset knob 45*d* extending upwardly through an opening of the upper plate and operable from outside of the upper plate. When the rotor stop member 45 is moved to the right in FIG. 5, the leading end of the locking arm 45*a* is brought into engagement with the rotor pinion 41*a* to mechanically stop the rotor pinion 41*a***.

A second stop means electrically stops rotation of a rotor. As shown, for example, in FIG. 6, a drive circuit of a motor is reset whereby its output is stopped. A lower plate 51 has a pin **51*a* to which a reset contact element 52 and a printed board 53 are fitted. The printed board 53 has an opening through which the pin 51*a* extends. An upper plate 54 has a cylindrical post 54*a* in contact with the printed board 53 adjacent to the opening. A stepping motor includes a drive circuit (not shown). The drive circuit has a reset pattern 53*a* which is formed on one side of the printed board 53 adjacent to the upper plate 54. The reset contact element 52 has a reset contact portion 52*a*** at its front end.

One end of the reset contact element 52 extends upwardly through an opening **53*b* of the printed board 53. When a rotor (not shown) is rotated, the reset contact portion 52*a* is spaced from and faces the reset pattern 53*a*. A reset member 55 is reciprocally moved on the upper plate 54. The reset member 55 has a press projection 55*a* which extends inwardly through an opening 54*b* of the upper plate 54. The other end of the reset contact element 52 is connected to a button battery 56 which serves as a power source for the drive circuit of the stepping motor. A battery lid 57 is attached to the upper plate 54 to prevent the button battery 56** from being moved out of the device.

When the reset member 55 is moved to the right in FIG. 6, the leading end of the press projection **55*a* urges the reset contact element 52 in a downward direction. This causes the reset contact portion 52*a* to come into contact with the reset pattern 53*a***, whereby the drive circuit is reset to stop its output and, therefore, stop the rotation of the rotor.

However, if the foregoing stop means is simply incorporated into a conventional timepiece movement which includes a coil spring and a stepping motor serving as a drive source to continuously rotate a second hand wheel substantially in a smooth manner, the second hand is subjected to extraordinary movement before or after it is stopped.

More specifically, with the prior art stop means for mechanically stopping rotation of the rotor or other wheel in the timepiece wheel train, if, for example, a wheel train upstream of the coil spring is stopped, the second hand cannot immediately be stopped until the coil spring is completely unwound after the wheel train is stopped. Conversely, if the stopping operation of the rotor or other wheel in the wheel train is terminated, the second hand cannot be moved until the coil spring is rewound to a predetermined amount, or the second hand may be moved, but at a speed less than the normal speed. Also, when a wheel train mounted downstream of the coil spring is stopped, the rotor is moved to the extent that the coil spring is wound. Accordingly, the second hand is rotated at a speed greater than the normal speed due to undue winding immediately after mechanical stoppage is terminated.

With the stop means for stopping the output pulse of the stepping motor to electrically stop the rotor, the second hand cannot be stopped immediately since the coil spring is only gradually unwound.

SUMMARY OF THE INVENTION

It is an object of the present invention to provide a timepiece movement wherein a stepping motor serves as a drive source to continuously rotate a second hand wheel substantially in a smooth manner.

Another object of the present invention is to provide timepiece movement including a second stop device which stops the second hand wheel immediately when a stop lever is moved in one direction, and which moves the second hand wheel at a predetermined speed immediately when the stop lever is moved in another direction.

The foregoing and other objects of the present invention are carried out by a timepiece movement comprising a printed board to which a drive circuit of a stepping motor is mounted and serves as a drive source to continuously rotate a second hand wheel substantially in a smooth manner, a speed reducing wheel train for transmitting intermittent rotary movement of a rotor to the second hand wheel, and a second stop device. The rotor is intermittently rotated by the stepping motor. The speed reducing wheel train includes movement conversion means for converting the intermittent rotary movement of the rotor to continuous rotary movement of the second hand wheel. The movement conversion means includes an elastic member disposed between a first gear and an intermediate gear coaxially and rotatably mounted to the first gear, or between a rotary member mounted to one of the first gear and the intermediate gear in face-to-face relation to the other of the first gear and the intermediate gear, and viscosity resistance imparting means for imparting viscosity resistance to one of a group of gears located downstream of and driven by the intermediate gear. The second stop device includes a stop lever engageable with and detachable from the intermediate gear or a second gear as one of the group of gears located downstream of and driven by the intermediate gear, and a reset contact element which is moved with displacement of the stop lever and adapted to reset the drive circuit of the stepping motor.

Preferably, the stop lever is integrally formed with a locking projection and a press projection. The locking projection is engaged with the intermediate gear or the second gear when the stop lever is moved in one direction, and is disengaged from the intermediate gear or the second gear when the stop lever is moved in another direction. The press projection presses the reset contact element to cause the reset contact element to be contacted with a predetermined circuit pattern formed on the printed board when the stop lever is moved in the one direction and causes the reset contact element to be separated from the predetermined pattern when the stop lever is moved in the other direction. The drive circuit is reset to stop its output when the predetermined pattern and the reset contact element are brought into contact with each other.

Instead of providing the reset contact element, the second stop device may include a stop lever simultaneously engageable with and detachable from the first gear or a gear located upstream of the first gear and the intermediate gear or a gear located downstream of the intermediate gear.

DETAILED DESCRIPTION OF THE PREFERRED EMBODIMENTS

Figure 1:
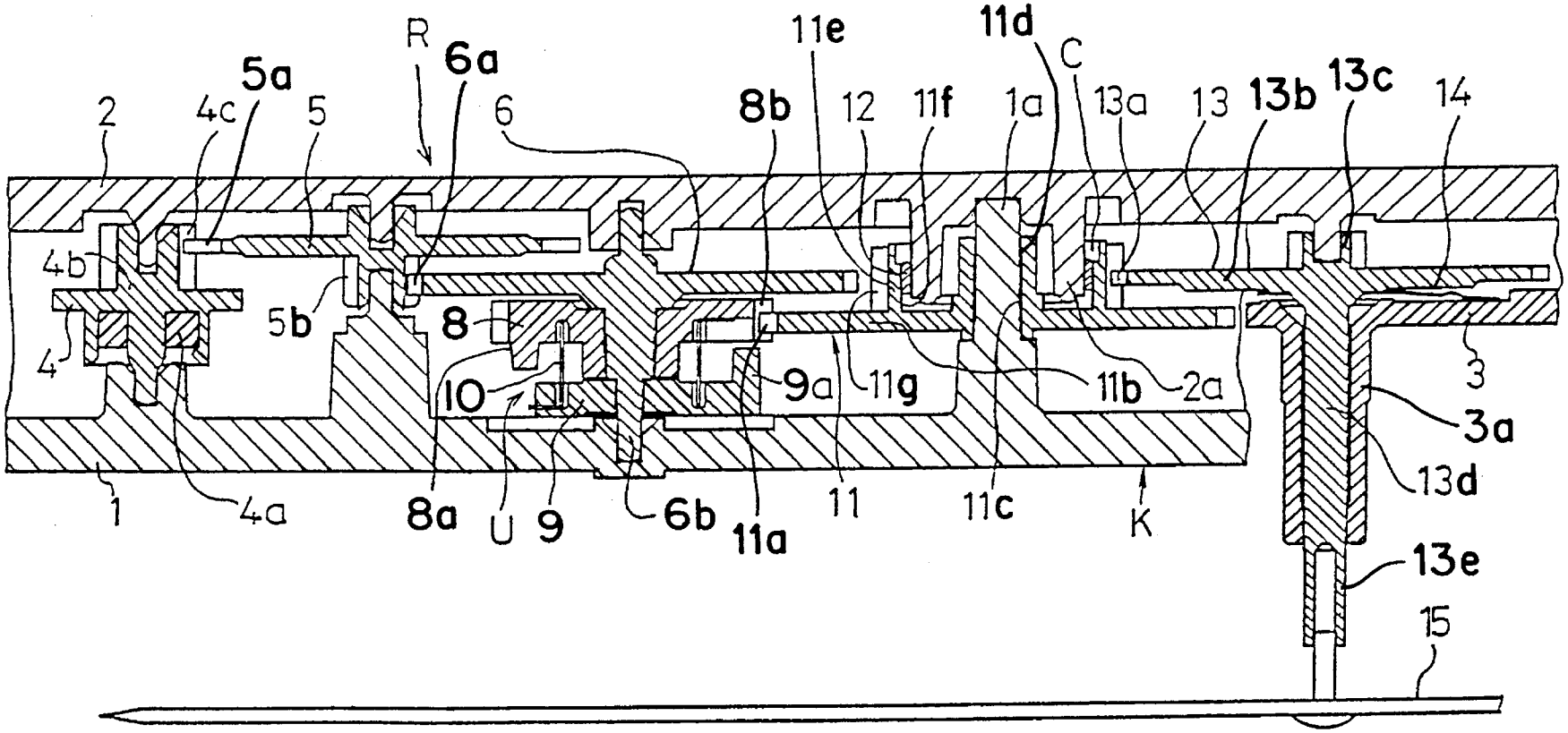
FIG. 1 is a sectional view of principal components of a first embodiment of the present invention.

Preferred embodiments of the present invention will now be described with reference to the accompanying drawings where like reference numerals designate the same parts throughout.

As shown in FIG. 1, a timepiece movement has a lower plate 1, an upper plate 2 facing the lower plate 1 and an intermediate plate 3 disposed between the upper and lower plates. Each of the lower plate 1, the upper plate 2, and the intermediate plate 3 has protrusions and bearing hole portions for supporting a conventional stepping motor S (see FIG. 2), which will be described later, and a speed reducing gear train R. A rotor 4 is intermittently rotated by the stepping motor S. The speed reducing gear train R transmits the intermittent rotary movement of the rotor 4 to a second hand wheel 13. More particularly, the speed reducing wheel train R includes movement conversion means U for converting the intermittent rotary movement of the rotor 4 to continuous rotary movement of the second hand wheel 13, as will be described in further detail below.

The rotor 4 has a magnet **4*a*, a rotor shaft 4*b* rotatably supported at opposite ends thereof by the lower plate 1 and the upper plate 2, and a rotor pinion 4*c* which forms an integral part of the rotor shaft 4*b* and is intermittently rotated by the stepping motor S. The rotor pinion 4*c* meshes with a large diameter tooth portion 5*a* of a driving wheel 5. The driving wheel 5 has a small diameter tooth portion 5*b* which meshes with a large diameter tooth portion 6*a* of a third wheel 6 (first gear) to transmit the intermittent rotation of the rotor pinion 4*c* to the third wheel 6**.

The third wheel 6 has a shaft portion **6*b* rotatably supported at opposite ends thereof by respective bearing hole portions of the lower plate 1 and the upper plate 2. An intermediate gear 8 (second gear) is rotatably and coaxially fitted over the shaft portion 6*b*. A rotary body or disk 9 is coaxially fitted over the shaft portion 6*b* for rotation therewith and is positioned between the intermediate gear 8 and the lower plate 1. An elastic member 10, such as a coil spring, is disposed coaxially with the shaft portion 6*b* and is supported by and between the disk 9 and the intermediate gear 8 for transmitting the intermittent rotation of the disk 9 to the intermediate gear 8. Upon rotation of the disk 9, the elastic member 10 is tightened and absorbs a torque from the disk 9 which is transferred to the intermediate gear 8 to rotate the same. The elastic member 10 absorbs velocity variations due to the intermittent rotation of the disk 9, whereby a smooth, continuous rotary movement is transmitted to the intermediate gear 8**.

The intermediate gear 8 has a projection **8*a*, and the disk 9 has a projection 9*a* at its outer edge. The projections 8*a*, 9*a* define means for preventing the elastic member 10 from being tightened beyond a predetermined allowable limit and breaking in the event that an unexpected load bears on the third wheel 6. If any force bearing on the elastic member 10 tends to tighten it beyond the predetermined allowable limit, the projection 8***a* of the intermediate gear engages the projection 9*a* of the disk 9 to prevent further rotation of the disk 9 so that no further force may bear on the elastic member 10.

The intermediate gear 8 has a tooth portion 8*b* which meshes with a tooth portion 11*a* of a disk portion 11*b* of a fourth wheel (third gear) 11. The fourth wheel 11 is rotatably mounted on a protrusion la projecting from the lower plate 1 into a central bore 11*c* of a boss or tubular portion 11*d* of the fourth wheel 11. A tubular wall portion 11*e* projects from an upper surface of the disk portion 11*b* and is disposed coaxially with and spaced from the tubular portion 11*c* to define a cavity 11*f* therebetween. The tubular wall portion 11*e* provides increased rigidity for the disk portion 11*b* to prevent it from being bent during rotation of the fourth wheel 11.

A pinion 11*g* forms an integral part of the tubular wall portion 11*e*. A tubular protrusion 2*a* projects from the upper plate 2 and is fitted coaxially over the tubular portion 11*d* of the fourth wheel 11 and extends loosely into the cavity 11*f*. The tubular wall portion 11*e*, the cavity 11f and the protrusion 2*a* define therebetween a clearance C. A viscous fluid 12, such as grease, is disposed within the clearance C for imparting a viscosity resistance load to the fourth wheel 11. The cavity 11*f* is also utilized for holding the viscous fluid employed as a means for imparting viscosity resistance.

It will be appreciated by those of ordinary skill in the art that the cavity 11*f* facilitates the fabrication of the fourth wheel 11 with high structural rigidity. In particular, when the fourth wheel is fabricated by a conventional molding process using a plastic material, the cavity 11*f* prevents a large quantity of plastic from flowing to the tubular portion 11*d*. The presence of the cavity 11*f* reduces the quantity of plastic material present at the tubular portion 11*d* of the fourth wheel 11 so that upon cooling of the injection molded fourth wheel 11, only minimal compressive forces due to shrinkage of the plastic material are applied to the center region of the disk portion 11*b*. As a result, the outer peripheral portion of the disk portion 11*b* is not deformed or bent during cooling, so that the disk portion 11*b* remains flat (as opposed to becoming bowed or cupped), thereby ensuring full surface contact between the tooth portions 8*b* and 11*a* of the intermediate gear 8 and the fourth wheel 11.

The pinion 11*g* meshes with a large diameter tooth portion 13*a* of the second hand wheel 13. The viscous fluid 12 functions as a lubricant for the rotation of the second hand wheel 13 and, owing to its viscosity, also functions to absorb any variation in velocity due to the intermittent rotation transmitted from the third wheel 6. Thus, the viscous fluid 12 completely absorbs any variation that still remains in the rotation velocity of the third wheel 6 due to its intermittent nature, after absorption of velocity variation by the elastic member 10, so that the second hand wheel 13 is able to undergo substantially smooth and continuous rotary movement.

The second hand wheel 13 has a disk portion 13*b*, a tubular portion 13*c* extending from an upper surface of the disk portion 13*b*, and a shaft portion 13*d* extending from a lower surface of the disk portion 13*b*. The tubular portion 13*c* is rotatably mounted on a protrusion extending from the upper plate 2. The shaft portion 13*d* projects through a tubular portion 3*a* of the intermediate plate 3 and passes through the lower plate 1 to the outside, and a second indicating hand 15 is mounted on a projecting end 13*e* of the shaft portion 13*d*. Tubular portions or pipes (not shown) are fitted coaxially over the projecting end 13*e* of the shaft portion 13*d* in a conventional manner, and a minute indicating hand (not shown) and an hour indicating hand (not shown) are respectively mounted on the tubular portions in a conventional manner. A spring 14 is fitted between the disk portion 13*b* of the second hand wheel 13 and the intermediate plate 3 in resilient contact therewith for restricting the motion of the second hand wheel 13.

It is understood by those of ordinary skill in the art that the driving wheel 5, the third wheel 6, the intermediate gear 8, the disk 9, the fourth wheel 11 and the second hand wheel 13 may be fabricated by conventional manufacturing methods using suitable high strength, low weight materials. For example, the foregoing components may be fabricated by an injection molded process using a hard plastic material.

In this embodiment, the viscous fluid 12 or means for imparting viscosity resistance is provided in the fourth wheel 11. However, it is understood that the viscous fluid 12 may be provided in any one of the third wheel 6 or the second hand wheel 13.

In this embodiment, the elastic member 10 comprises a coil spring, such as a flat, spirally wound spring. However, it is understood by those skilled in the art that the elastic member 10 may comprise any suitable means for absorbing a torque from the disk 9 and transmitting a rotary torque to the intermediate gear 8. Similarly, although the elastic member 10 is disposed between the disk 9 and the intermediate gear 8 in this embodiment, the elastic member 10 may be disposed between the third wheel 6 and the intermediate gear 8 without employing the disk 9. As a further alternative, the intermediate gear 8 may have a shaft by which the third wheel 6 is journaled, and the disk 9 may be tightly fitted around the shaft of the intermediate gear 8 and rotatable therewith. Opposite ends of the elastic member 10 may be engaged with the third wheel 6 and the disk 9.

Figure 2:
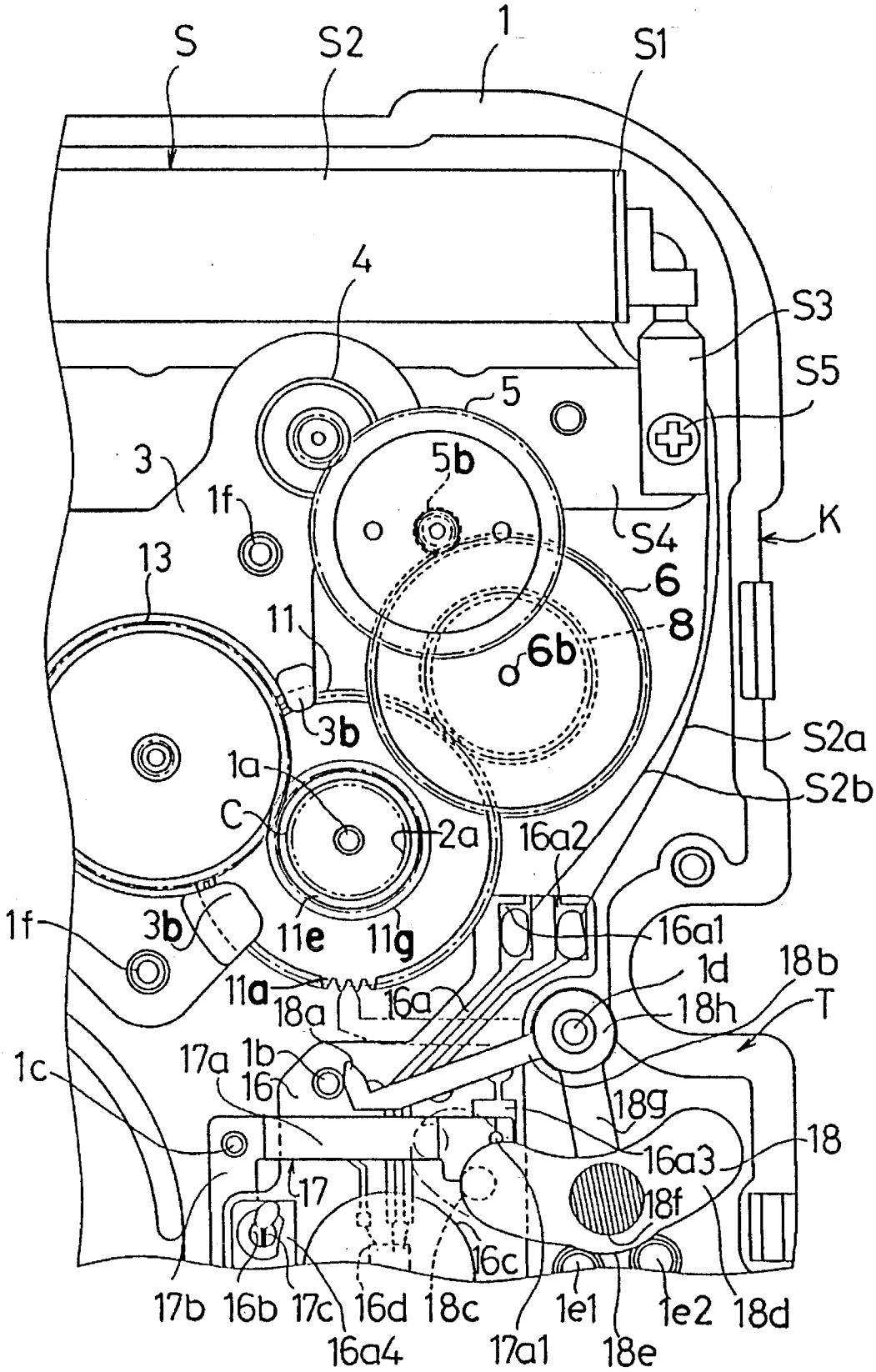
FIG. 2 is a plan view showing the principal components of the first embodiment of the present invention.

As shown in FIG. 2, the stepping motor S comprises a coil frame S1, a coil S2, an iron core S3, a stator S4, a stator setscrew S5, and the rotor 4. The stator setscrew S5 secures the iron core S3 and the stator S4 together. A mounting pin 1*b* extends from the lower plate 1. A printed board 16 is mounted to the mounting pin lb. A circuit pattern 16*a* is formed on the upper surface of the printed board 16 and faces the upper plate 2.

The circuit pattern 16*a* has two terminals 16*a*1, 16*a*2. The coil S2 has two ends S2*a*, S2*b* soldered to the two terminals 16*a*1, 16*a*2, respectively. A reset contact element 17 is comprised of a resilient metal such as SUS and has a reset contact 17*a* at its one end thereof. The circuit pattern 16*a* has a reset pattern 16*a*3 in confronting relation to a contact 17*a*1 which extends downwardly from the reset contact 17*a*.

Figure 3:
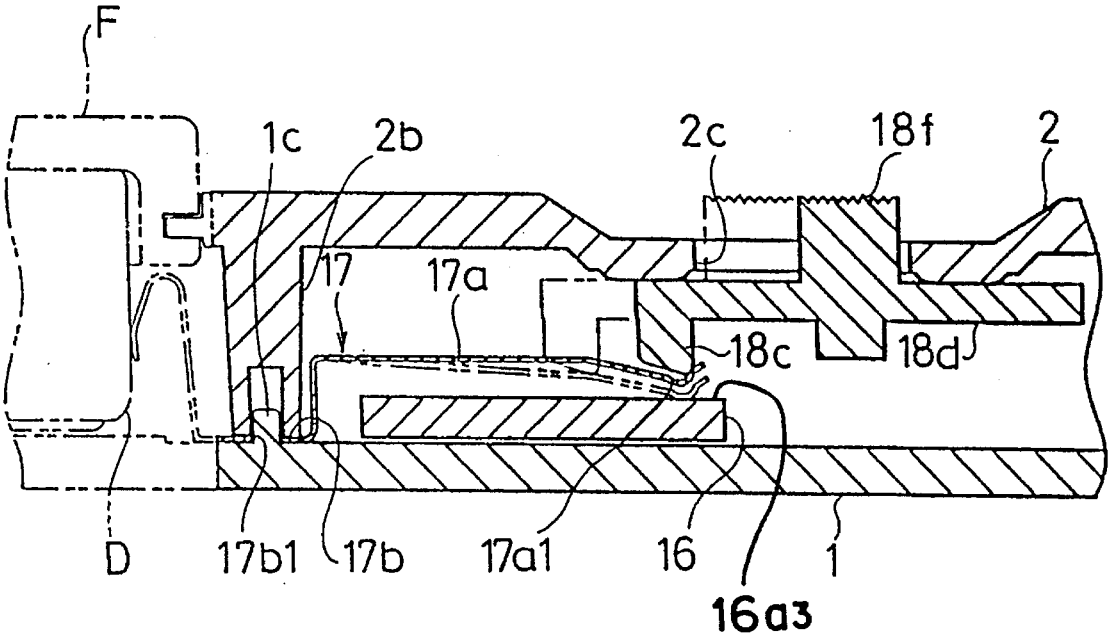
FIG. 3 is another sectional view showing principle components of the first embodiment of the present invention.

As shown in FIG. 3, the reset contact element 17 has a central base portion 17*b* in which an aperture 17*b*1 is formed to receive a pin 1*c* extending from the lower plate 1. A cylindrical press post 2*b* extends from the upper plate 2 and is in contact with a portion of the lower plate 1 around the aperture 17*b*1. The other end of the reset contact element 17 is connected to a button battery D as a power source for the drive circuit of the stepping motor S. A battery lid F is attached to the upper plate 2 to prevent outward movement of the button battery D.

Referring again to FIG. 2, the reset contact 17*a* of the reset contact element 17 extends upwardly from the base portion 17*b* and is then bent rearwardly and downwardly. The front end of the reset contact element 17 projects downwardly and is substantially arcuate in section, defining an arcuate projection which forms the contact 17*a*1.

The base portion 17*b* has a tongue-like securement portion 17*c*. The printed board 16 has a through hole 16*b* through which the securement portion 17*c* extends upwardly and terminates at the upper surface of the printed board 16 where the circuit pattern 16*a* is formed. This securement portion 17*c* is soldered to a circuit pattern 16*a*4. A mounting pin 1*d* extends from the lower plate 1. A stop lever 18 is rotatably mounted on the mounting pin 1*d*.

The stop lever 18 is integrally formed with a locking projection 18*a*, a locking arm 18*b*, a press projection 18*c*, a plate 18*d*, a click projection 18*e*, a reset knob 18*f*, an operating arm 18*g*, and a cylindrical bearing 18*h*.

The locking projection 18*a* is configured to mesh with the teeth 11*a* of the fourth wheel 11 and extends from one end of the locking arm 18*b*. The press projection 18*c* is moved in one direction to press the reset contact 17*a*. This causes the reset pattern 16*a*3 of the circuit pattern 16*a* to contact the reset contact 17*a*. When the press projection 18*c* is moved in the other direction, the reset contact 17*a* is separated from the reset pattern 16*a*3 of the circuit pattern 16*a*.

The press projection 18*c* extends from one end of the plate 18*d*. The plate 18*d* is rotated about the mounting pin 1*d* and has an arcuate outer periphery. The click projection 18*e* is arcuate in shape and extends outwardly from the center of the plate 18*d*. The reset knob 18*f* is located near the center of the click projection 18*e*. The operating arm 18*g* extends from the center of the plate 18*d* toward the mounting pin 1*d*. The other end of the locking arm 18*b* and the operating arm 18*g* extend at right angles to one another and are connected to the cylindrical bearing 18*h*. A pair of click posts 1*e*1, 1*e*2 extend from the lower plate 1 and are separated at equal distance from the mounting pin 1*d*. The click projection 18*e* can be positioned between the front ends of the click posts 1*e*1, 1*e*2. The timepiece movement K is driven when the click projection 18*e* is in this position.

Referring again to FIG. 3, the reset knob 18*f* extends upwardly through an opening 2*c* which is formed in the upper plate 2. The reset knob 18*f* is rotated about the mounting pin 1*d* and can be operated from outside of the upper plate 2. When the timepiece is driven under a normal condition, the locking projection 18*a* is separated from the teeth 11*a* of the fourth wheel 11, and the reset pattern 16*a*3 and the reset contact 17 (shown in solid line) are separated from each other. A drive circuit (not shown) is mounted on the printed board 16 and includes circuit elements, such as an IC 16*d*, encapsulated by an encapsulating resin 16*c*. The drive circuit is reset when the reset pattern 16*a*3 and the reset contact 17*a* are brought into contact with one another. At this point, the feeding of a drive current to the stepping motor S is stopped, thereby stopping the rotation of the rotor 4.

Referring again to FIG. 2, the intermediate plate 3 includes a plurality of locking portions 3*b* which extend over the top of the fourth wheel 11 and prevent the fourth wheel 11 from being moved with the upper plate 2 due to the viscosity of the viscous fluid 12 in a direction toward the upper plate (upward direction in FIG. 2) when the upper plate 2 is separated from the lower plate 1. The lower plate 1 has a post 1*f*. The intermediate plate 3 is fitted onto the post if and is also positioned by a press post (not shown) of the upper plate 2.

When the rotor 4 is intermittently rotated by the stepping motor. S, the intermittent rotation is transmitted to the third wheel 6 by the driving wheel 5. The rotation of the third wheel 6 is transmitted from the disk 9 to the intermediate gear 8 by the elastic member 10. When the intermittent rotation transmitted to the disk 9 is transmitted by the elastic member 10, its velocity variation is absorbed by the elastic member 10 and a smooth, continuous rotary movement is transmitted to the intermediate gear 8. The intermediate gear 8, in turn, rotates the fourth wheel 11 with which it meshes. At this point, the viscous fluid 12 completely absorbs any remaining variation in velocity after it is absorbed by the elastic member 10 so that the fourth wheel 11 transmits a smooth and continuous rotational motion to the second hand wheel 13 and, therefore, to the second indicating hand 15.

A second stop device T of the timepiece movement K comprises the stop lever 18 which is engaged with and disengaged from the teeth 11*a* of the fourth wheel 11, and the reset contact element 17 which is moved with displacement of the stop lever 18 to reset the drive circuit of the stepping motor S.

In this embodiment, the stop lever 18 is engaged with and disengaged from the fourth wheel 11. Alternatively, the stop lever 18 may be engaged with and disengaged from the intermediate gear 8 or any of wheels of the wheel train driven by and located downstream of the intermediate gear 8, except for the fourth wheel 11.

Reference will next be made to the operation of the stop lever 18.

The timepiece movement K is driven under a normal condition when the stop lever 18 is in a position as shown by solid line in FIG. 2. To correct the time, the reset knob 18*f* of the stop lever 18 is rotated in a clockwise direction from outside of the upper plate 2 while the timepiece is driven under a normal condition. The click post 1e1 is then bent downwardly by the click projection 18*e*. The click projection 18*e* is stopped when it is moved over the click post 1*e*1. At this time, the locking projection 18*a* is meshed with the teeth 11*a* of the fourth wheel 11, and the reset pattern 16*a*3 and the reset contact 17*a* (shown in broken line in FIG. 3) are moved with the displacement of the reset knob 18*f* and pressed against one another to provide an electrical connection. The reset circuit is then reset to stop its output. In this state, the state-of-charge of the elastic member 10 remains the same as the timepiece movement K is driven. Finally, the stepping motor S and the second hand wheel 13 are simultaneously stopped.

When the reset knob 18*f* is rotated in a counterclockwise direction, the click post 1e1 is bent downwardly by the click projection 18*e*. The click projection 18*e* is stopped when it is moved over the click post 1*e*1, and is then positioned between the click posts 1*e*1 and 1*e*2. At this time, the locking projection 18*a* is separated from the teeth 11*a* of the fourth wheel 11, and the reset pattern 16*a*3 and the reset contact 17*a*(shown by solid line in FIG. 3) are separated from one another. The drive circuit is then reset to supply its output, immediately allowing for normal movement of the second hand wheel 13.

Figure 4:
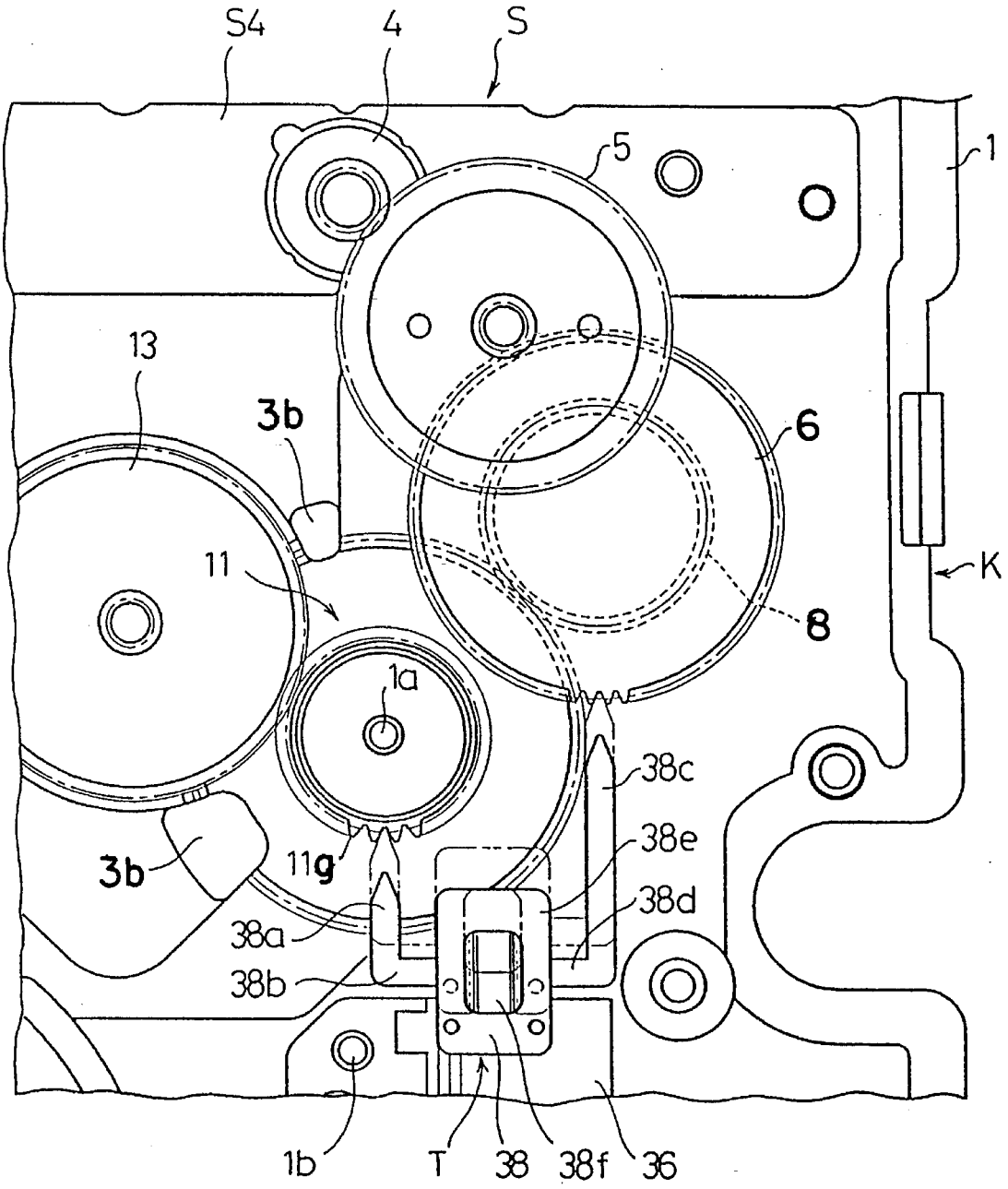
FIG. 4 is a plan view showing the principal components of a second embodiment of the present invention.
Figure 5:
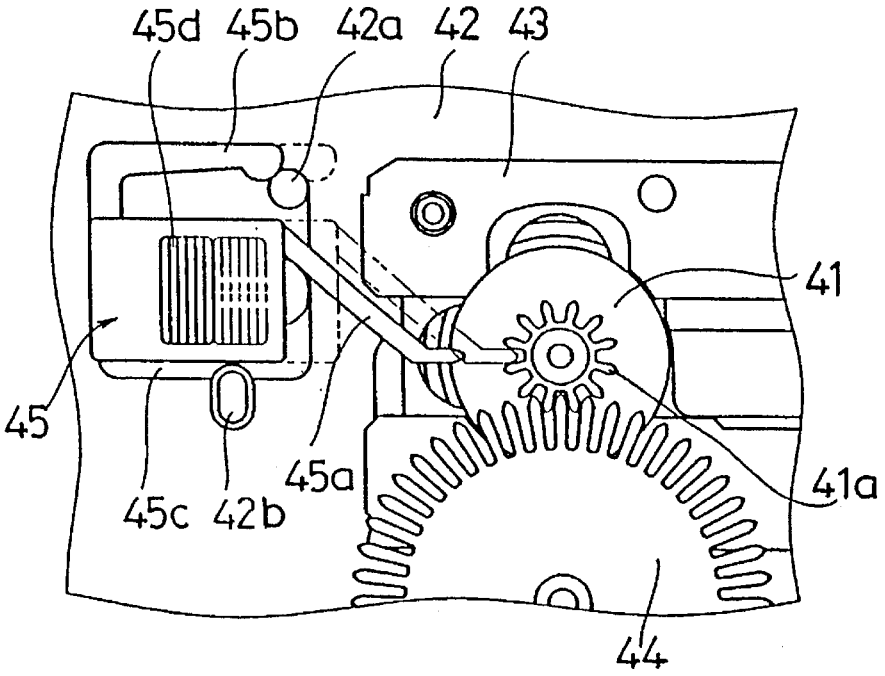
FIG.5 PRIOR ART
FIG. 5 is a partial plan view of a conventional second stop for a timepiece movement device.
Figure 6:
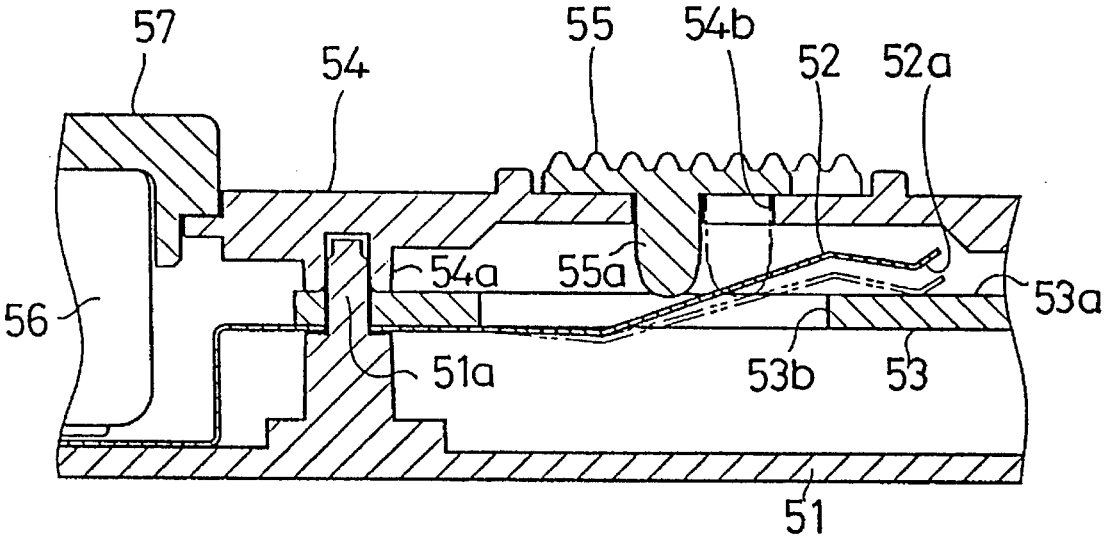
FIG.6 PRIOR ART
FIG. 6 is a partial sectional view of another conventional second stop device for a timepiece movement.

FIG. 4 shows another embodiment of the present invention. A printed board 36 is mounted to the mounting pin 1*b* which extends from the lower plate 1. A circuit pattern 36*a* is formed on the upper surface of the printed board 36. The circuit pattern 36*a* has two terminals, not shown, to which two ends, not shown, of the coil S2 are soldered.

The second stop device T comprises a stop lever 38 integrally formed with a first locking projection 38*a*, a first locking arm 38*b*, a second locking projection 38*c*, a second locking arm 38*d*, a support plate 38*e*, and an integral control knob 38*f*. The stop lever 38 is simultaneously engaged with and disengaged from the third wheel 6 and the fourth wheel 11, located downstream of the intermediate gear 8. That is, the first locking projection 38*a* is formed to engage with the pinion 11*g* of the fourth wheel 11, and the second locking projection 38*c* is formed to engage with the third wheel 6. The first locking projection 38*a* extends from one end of the locking arm 38*b*. The second locking projection 38*c* extends from one end of the locking arm 38*d*. The other end of the locking arm 38*b* and the other end of the locking arm 38*d* face against each other and are connected to the support plate 38*e*.

In this embodiment, the stop lever 38 is simultaneously engaged with and disengaged from the third wheel 6 and the fourth wheel 11. Alternatively, the stop lever 38 may simultaneously be engageable with any wheel upstream of the third wheel 6 and the intermediate gear 8, or any wheel downstream of the intermediate gear 8 other than the fourth wheel 11.

The upper plate 2 which is located above the lower plate 1 includes an opening (not shown), and the control knob 38*f* extends upwardly through this opening. The control knob 38*f* is guided by the opening of the lower plate 1 and is reciprocally moved on the top of the upper plate 2. When the timepiece movement K is driven under a normal condition, the locking projection 38*c* (shown in solid line) is separated from the third wheel 6.

The operation of the stop lever 38 will now be described with reference to FIG. 4.

The stop lever 38 is in a position shown by solid line in FIG. 4 when the timepiece movement K is driven under a normal condition. To correct the time, the stop lever 38 is operated from outside of the upper plate 2 and displaced toward the fourth wheel 11 (in an upward direction in FIG. 4) while the timepiece movement K is driven under a normal condition as described above. The control knob 38*f* is moved a distance within the opening of the upper plate 2 to a predetermined position and then stopped. When the control knob 38*f* is in the predetermined position, the locking projection 38*a* (shown in broken line) is meshed with the pinion 11*g* of the fourth wheel 11, and the locking projection 38*c* (shown in broken line) is meshed with the third wheel 6. In this state, the elastic member 10 is wound by the same amount as the timepiece movement K is driven. Finally, the second hand wheel 13 is stopped.

If the stop lever 38 is displaced in a direction opposite to the fourth wheel 11 (in a downward direction in FIG. 4), the control knob 38*f* is stopped after it is moved from the predetermined position within the opening of the upper plate 2. When the stop lever 38 is moved from the predetermined position, the locking projection 38*a* (shown in solid line) is disengaged from the pinion 11*g* of the fourth wheel 11. Also, the locking projection 38*c* (shown in solid line) is disengaged from the third wheel 6. The second hand wheel 13 is immediately returned to its normal condition.

According to the present invention, the second stop device comprises the stop lever engageable with the intermediate gear or the fourth wheel, and the reset contact element is cooperatively moved with the stop lever and adapted to reset the drive circuit of the stepping motor. As such, the state-of-charge of the elastic member is left unchanged when the stop lever is displaced to stop the second hand wheel. This arrangement enables the second hand wheel to be stopped in any desired position, and also allows for normal operation of the second hand wheel immediately after the stop operation of the second hand is terminated.

The stop lever is integrally formed with the locking projection and the press projection. When the stop lever is moved in one direction, the locking projection is brought into engagement with the intermediate gear or the fourth wheel. When the stop lever is moved in another direction, the locking projection is disengaged from the intermediate gear or the fourth wheel. When the stop lever is moved in the one direction, the press projection presses the reset contact element to cause the reset contact element to be contacted with a predetermined pattern formed on the printed board. When the stop lever is moved in the other direction, the reset contact element is disengaged from the predetermined pattern. When the predetermined pattern and the reset contact element are in contact with each other, the drive circuit is reset and its output is no longer fed. Thus, by simply moving a single stop lever in the one or the other direction, the stepping motor and the second hand wheel can simultaneously be driven or stopped.

The same operation and advantages can be obtained if the second stop device is comprised of a stop lever simultaneously engaged with and disengaged from wheels upstream of the third wheel and the intermediate gear or simultaneously with wheels downstream of the intermediate gear. This arrangement simplifies and reduces the production cost of the second stop device since its mechanism has no relation to the drive circuit of the stepping motor.

We claim:

1. A timepiece movement comprising: a first gear; intermittent rotating means for intermittently rotating the first gear; a second gear; first transmitting means for transmitting the intermittent rotation of the first gear to the second gear; a third gear; second transmitting means for transmitting the rotation of the second gear to the third gear; third transmitting means for transmitting the rotation of the third gear to a second hand wheel; means for absorbing a velocity variation due to the intermittent rotation of the third gear to thereby transmit a smooth and continuous rotary movement to the second hand wheel; and stop means for simultaneously stopping rotation of the first gear and the third gear when the stop means is in a first state, the first gear and the third gear being simultaneously allowed to rotate at respective predetermined velocities thereof when the stop means is in a second state.

2. A timepiece movement as claimed in claim 1; further comprising support means for rotatably supporting the third gear.

3. A timepiece movement as claimed in claim 2; wherein the support means comprises a shaft portion, and the third gear comprises a disk portion having first and second surfaces and a tubular portion extending from the first surface and mounted for rotation on the shaft portion of the support means.

4. A timepiece movement as claimed in claim 3; wherein the means for absorbing a velocity variation comprises a tubular wall portion extending from the first surface of the disk portion of the third gear and disposed coaxially with and spaced from the tubular portion of the disk portion to define a cavity therebetween, a tubular shaft portion projecting from the support means and extending into the cavity to define a clearance between the tubular shaft portion, the cavity and the tubular wall portion, and a viscous fluid disposed in the clearance.

5. A timepiece movement as claimed in claim 4; wherein the second hand wheel has a tooth portion, and the third transmitting means comprises a tooth portion of the tubular wall portion of the third gear in meshing engagement with the tooth portion of the second hand wheel.

6. A timepiece movement as claimed in claim 4; wherein the second hand wheel has a tooth portion, and the third transmitting means comprises a pinion fitted coaxially over the tubular wall portion of the third gear in meshing engagement with the tooth portion of the second hand wheel.

7. A timepiece movement as claimed in claim 4; wherein the first transmitting means includes means for absorbing a velocity variation due to the intermittent rotation of the first gear.

8. A timepiece movement as claimed in claim 7; wherein the first gear comprises a shaft portion rotatably supported by the support means, the second gear being mounted on the shaft portion of the first gear for relative rotation therewith; and wherein the means for absorbing a velocity variation due to the intermittent rotation of the first gear comprises a disk member mounted on the shaft portion of the first gear for rotation therewith, and an elastic member disposed between the disk member and the second gear.

9. A timepiece movement as claimed in claim 8; wherein the elastic member comprises a coil spring.

10. A timepiece movement as claimed in claim 1; wherein the first transmitting means includes means for absorbing a velocity variation due to the intermittent rotation of the first gear.

11. A timepiece movement as claimed in claim 1; wherein the stop means comprises a stop lever for simultaneous engagement with the first gear and the third gear when the stop means is in the first state and for simultaneous disengagement from the first gear and the third gear when the stop means is in the second state.

12. A timepiece movement as claimed in claim 1; further comprising drive circuit means for driving the intermittent rotating means; and wherein the stop means comprises a stop lever for engagement with the third gear when the stop means is in the first state and for disengagement from the third gear when the stop means is in the second state, and a reset contact element for resetting the drive circuit means when the stop means is in the first state.

13. A timepiece movement comprising: a first gear; intermittent rotating means for intermittently rotating the first gear; a printed board; drive circuit means disposed on the printed board for driving the intermittent rotating means; a second gear coaxially mounted to the first gear for rotation therewith; a rotary body mounted to one of the first gear and the second gear for rotation therewith; a third gear rotationally driven by the second gear; movement conversion means for converting intermittent rotary movement of the first and second gears to continuous rotary movement of a second hand wheel; and stop means for simultaneously stopping rotation of the first gear and the third gear when the stop means is in a first state, the first gear and the third gear being simultaneously allowed to rotate at respective predetermined velocities thereof when the stop means is in a second state.

14. A timepiece movement as claimed in claim 13; wherein the movement conversion means comprises an elastic member disposed between the first gear and one of the second gear and the rotary body, and absorbing means for absorbing a velocity variation due to the intermittent rotation of the third gear.

15. A timepiece movement as claimed in claim 14; wherein the stop means comprises a stop lever for engagement with the third gear when the stop means is in the first state and for disengagement from the third gear when the stop means is in the second state, and a reset contact element for engagement with the stop lever for resetting the drive circuit means when the stop means is in the first state.

16. A timepiece movement as claimed in claim 15; wherein the stop lever comprises a locking projection for engagement with one of the second gear and the third gear when the stop means is in the first state, and a press projection for pressing the reset contact element into contact with a circuit pattern formed on the printed board when the stop means is in the first state and separating the reset contact element from the circuit pattern when the stop means is in the second state, the drive circuit means being reset to stop driving the intermittent rotating means when the circuit pattern and the reset contact element are in contact with one another.

17. A timepiece movement comprising: a first gear; intermittent rotating means for intermittently rotating the first gear; a second gear coaxially mounted to the first gear for rotation therewith; a rotary body mounted to one of the first gear and the second gear for rotation therewith; a third gear rotationally driven by the second gear; movement conversion means for converting intermittent rotary movement of the first and second gears to continuous rotary movement of a second hand wheel; and a stop device having a stop lever for simultaneous engagement with the first gear and the third gear to simultaneously stop rotation thereof when the stop lever is in a first state and for simultaneous disengagement from the first gear and the third gear to simultaneously allow rotation thereof at respective predetermined velocities when the stop lever is in a second state.

18. A timepiece movement as claimed in claim 17; wherein the movement conversion means comprises an elastic member disposed between the first gear and one of the second gear and the rotary body, and absorbing means for absorbing a velocity variation due to the intermittent rotation of the third gear.

19. A timepiece movement comprising: a first gear; intermittent rotating means for intermittently rotating the first gear; a second gear; first transmitting means for transmitting the intermittent rotation of the first gear to the second gear; a third gear; second transmitting means for transmitting the rotation of the third gear to a second hand wheel; and stop means for simultaneously stopping rotation of the first gear and the third gear when the stop means is in a first state, the first gear and the third gear being simultaneously allowed to rotate at respective predetermined velocities when the stop means is in a second state.

20. A timepiece movement as claimed in claim 19; further comprising drive circuit means for driving the intermittent rotating means; and wherein the stop means comprises a stop element for engagement with the third gear when the stop means is in the first state and disengagement from the third gear when the stop means is in the second state, and a reset contact element for resetting the drive circuit means to stop driving the intermittent rotating means when the stop means is in the first state.

21. A timepiece movement as claimed in claim 20; wherein the stop lever comprises a locking projection for engagement with the third gear when the stop means is in the first state, and a press projection for pressing the reset contact element into contact with a circuit pattern of the drive circuit means when the stop means is in the first state and separating the reset contact element from the circuit pattern when the stop means is in the second state, the drive circuit means being reset to stop driving the intermittent rotating means when the circuit pattern and the reset contact element are in contact with one another.

22. A timepiece movement as claimed in claim 19; wherein the stop means comprises a stop lever for simultaneous engagement with the first gear and the third gear when the stop means is in the first state and for simultaneous disengagement from the first gear and the third gear when the stop means is in the second state.

23. A timepiece movement as claimed in claim 22; wherein the stop means comprises a stop lever having a pair of locking projections each respectively engaging one of the first gear and the third gear when the stop means is in the first state.

* * * * *